US006532973B1

(12) United States Patent
Gross et al.

(10) Patent No.: US 6,532,973 B1
(45) Date of Patent: Mar. 18, 2003

(54) GLOSS RETENTION COMPOSITIONS

(75) Inventors: Stephen F. Gross, Souderton, PA (US); Timothy C. Morris, Morton, PA (US); Michael S. Wiggins, Lansdale, PA (US); Robert J. Valesky, Hatboro, PA (US)

(73) Assignee: Cognis Corporation, Gulph Mills, PA (US)

( * ) Notice: Subject to any disclaimer, the term of this patent is extended or adjusted under 35 U.S.C. 154(b) by 0 days.

(21) Appl. No.: 09/578,645

(22) Filed: May 25, 2000

Related U.S. Application Data

(60) Provisional application No. 60/193,901, filed on Mar. 31, 2000, provisional application No. 60/178,374, filed on Jan. 27, 2000, provisional application No. 60/161,446, filed on Oct. 26, 1999, and provisional application No. 60/138,492, filed on Jun. 10, 1999.

(51) Int. Cl.[7] ..... B08B 3/04; C11D 1/722; C11D 3/24; C11D 3/37

(52) U.S. Cl. ..... 134/25.2; 134/39; 134/40; 134/42; 510/238; 510/239; 510/240; 510/241; 510/421; 510/470; 510/474; 510/475

(58) Field of Search ..... 510/238–241, 510/421, 470, 474, 475; 134/25, 2, 39, 40, 42

(56) References Cited

U.S. PATENT DOCUMENTS

| | | | | | |
|---|---|---|---|---|---|
| 5,266,690 | A | | 11/1993 | McCurry, Jr. et al. | 536/18.6 |
| 5,827,453 | A | * | 10/1998 | Gross et al. | 252/321 |
| 5,895,605 | A | * | 4/1999 | Gross et al. | 252/351 |
| 5,929,283 | A | * | 7/1999 | Uno et al. | 564/506 |
| 6,028,041 | A | * | 2/2000 | Decoster et al. | 510/119 |
| 6,110,977 | A | * | 8/2000 | Gross et al. | 516/74 |

* cited by examiner

*Primary Examiner*—Yogendra N. Gupta
*Assistant Examiner*—Brian P. Mruk
(74) *Attorney, Agent, or Firm*—John E. Drach; Steven J. Trzaska

(57) ABSTRACT

A cleaning composition containing:

(A) an alkyl polyglycoside corresponding to formula I:

$$R^1O(R^2O)_b(Z)_a \qquad \text{I}$$

wherein $R^1$ is a monovalent organic radical having from about 6 to about 30 carbon atoms; $R^2$ is a divalent alkylene radical having from 2 to 4 carbon atoms; Z is a saccharide residue having 5 or 6 carbon atoms; b is a number having a value from 0 to about 12; a is a number having a value from 1 to about 6; and (B) at least one product of a reaction between:

a) at least one linking agent of formula IV:

$$R^4(Y)_3 \qquad \text{(IV)}$$

wherein each Y group is a halogen atom or one Y group is a halogen atom and two Y groups with two adjacent carbon atoms in the $R^4$ group and an oxygen atom form an epoxy group, and $R^4$ is an alkanetriyl group containing from 3 to 10 carbon atoms; and (b) at least one compound of formula (II)

$$R^3(EO)_n(PO)_m(BO)_pX \qquad \text{(II)}$$

wherein $R^3$ is a substituted or unsubstituted saturated or unsaturated, aliphatic oxy or thio group having from 1 to about 36 carbon atoms or a secondary amino group having from 2 to about 36 carbon atoms; n, m, and p are independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component a) to component b) is from about 0.2/1 to about 5/1.

44 Claims, No Drawings

GLOSS RETENTION COMPOSITIONS

CROSS-REFERENCE TO RELATED APPLICATIONS

This application claims the benefit of copending provisional application serial No.: 60/138,492 filed on Jun. 10, 1999; No. 60/161,446 filed on Oct. 26, 1999; No. 60/178,374 filed on Jan. 27, 2000 and No. 60/193,901 filed on Mar. 31, 2000; the entire contents of each of which are incorporated herein by reference.

BACKGROUND OF THE INVENTION

Aqueous cleaning compositions exhibit a tendency toward foaming because they contain surface active agents such as soaps, and synthetic detergents. In many instances, such cleaning compositions produce excessive foam and the user must use substances known as anti-foaming agents or defoamers. Some defoamers such as silicones tend to interfere with the function of the cleaning compositions in that unwanted residues are left after the cleaners are wiped off while others are environmentally unacceptable because they are not biodegradable. The unwanted residues are cloudy and reduce the shine or gloss of the surface that has been cleaned.

Alkyl polyglycosides are a class of nonionic surfactants that exhibit significantly higher foaming profiles than other nonionic surfactants, such as alcohol ethoxylates. In fact, it can be said that the foaming tendencies of alkyl polyglycosides more closely resemble those of anionic surfactants, such as alcohol sulfates, than the foaming tendencies of other nonionic surfactants. This higher foaming tendency makes the use of alkyl polyglycosides undesirable for many applications, e.g., cleaning-in-place for food processing plants, high pressure spray cleaning, bottle washing, floor cleaners and automatic dishwashing, wherein high levels of foam interfere with the cleaning and rinsing operation and reduce the efficiency of the operation. The shine or gloss characteristics of alkyl polyglycosides are much better then other surfactants. The residue left behind by the alkyl polyglycosides is generally clear and colorless and reduces the shine of the surface that has just been cleaned by only a few percent.

Low foam nonionics, such as ethoxylated/propoxylated block copolymers, can be used to reduce the foaming properties of alkyl polyglycoside surfactants, but these materials have undesirable properties, e.g., low biodegradability, relatively high aquatic toxicity and poor caustic compatibility.

Accordingly, there is a need for the development of defoamers that do not interfere with the cleaning ability of aqueous cleaning compositions and that are biodegradable, exhibit low aquatic toxicity and good caustic compatibility and do not leave an opaque residue that reduces the shine of the cleaned surface.

SUMMARY OF THE INVENTION

The present invention is directed to a gloss retention additive containing at least one reaction product of the reaction of a linking agent defined by formula (IV):

$$R^4(Y)_3 \qquad \text{(IV)}$$

wherein each Y group is a halogen atom or one Y group is a halogen atom and two Y groups with two adjacent carbon atoms in the $R^4$ group and an oxygen atom form an epoxy group, and $R^4$ is an alkanetriyl group containing from 3 to 10 carbon atoms, the preferred linking agent being epichlorohydrin; and compounds having the formula (II)

$$R^3(EO)_n(PO)_m(BO)_pX \qquad \text{(II)}$$

wherein $R^3$ is an alkyl group, alkenyl group, aryl group, arenyl group having from 1 to 36 carbon atoms and preferably from 4 to 22 carbon atoms, or a secondary amine having a total of from 1 to 36 carbon atoms and preferably from 4 to 22 carbon atoms; a substituted alkyl, alkenyl, aryl or arenyl group having from 1 to 36 carbon atoms and preferably from 4 to 22 carbon atoms; wherein n is a number from 0 to about 50; m is a number from 0 to about 50; wherein X is an alcohol group, a mercaptan group or an amine group; wherein when X is an alcohol group and $R^3$ is an alkyl group, alkenyl group, aryl group, or arenyl group, p is a number from 0 to about 50, and preferably from about I to about 50; when X is a mercaptan or an amine group, p is a number from 0 to 50; when $R^3$ is a secondary amine group, p is a number from 0 to about 50, preferably from about 1 to about 50; wherein the mole ratio of the linking compound (IV) to (II) is from about 0.2/1 to about 5/1, preferably from about 0.4/1 to about 2/1 and more preferably from about 0.6/1 to about 1.4/1, in combination with surfactant systems improves the gloss of substrates it cleans, increases detergency and, in addition, has surprisingly good caustic solubility. It is understood that EO stands for the residue of ethylene oxide and PO stands for the residue of propylene oxide and BO stands for the residue of butylene oxide. The substituted alkyl, alkenyl, aryl or arenyl may contain single or multiple substitutions such as a halogen substitution, for example Cl, Fl, I and Br; a sulfur functionality such as a mercaptan or thio group; a nitrogen functionality such as an amine or amide functionality; a silicon functionality such as a siloxane; an alcohol functionality; an ether functionality or any combination thereof.

More precisely, the compounds of formula 11 have the formula $$R^3(EO)_n(PO)_m(BO)_pX \qquad \text{(II)}$$

wherein $R^3$ is a substituted or unsubstituted, saturated or unsaturated, aliphatic oxy or thio group having from 1 to 36 carbon atoms or a secondary amino group having from 2 to 36 carbon atoms; n is a number of from 0 to 50, e.g., from 1 to 50; m is a number of from 0 to 50, e.g., from 1 to 50; p is a number of from 0 to 50, e.g., from 1 to 50; and X is hydrogen, or X can be a mercapto group or an amino group in place of a terminal —OH group, provided that when X is mercapto or amino, the sum of n, m, and p must be at least 1. In general, compounds of formula II wherein the sum of n, m, and p is at least 1, especially at least 2, are preferred. Examples of aliphatic groups when $R^3$ is an aliphatic oxy or thio group include substituted or unsubstituted alkyl groups having from 1 to 36 carbon atoms, preferably from 4 to 22 carbon atoms, alkenyl and alkynyl groups having from 2 to 36 carbon atoms, preferably from 4 to 22 carbon atoms, aryl groups having from 6 to 36 carbon atoms, and arenyl groups having from 7 to 36 carbon atoms. When the above groups are substituted groups, the groups can contain single or multiple substitutions such as a halogen substitution, for example Cl, Fl, I and Br; a sulfur functionality such as a mercaptan or thio group; a nitrogen functionality such as an amine or amide functionality; a silicon functionality; or any combination thereof.

When $R^3$ is a secondary amino group, the group preferably contains from 4 to 22 carbon atoms.

Also, when X is hydrogen p is preferably a number of from 1 to 50. When $R^3$ is a secondary amino group, p is preferably a number of from 1 to 50.

The mole ratio of the linking compound (IV) to (II) is from about 0.2/1 to about 5/1, preferably from about 0.4/1 to about 2/1 and more preferably from about 0.4/1 to about 1.6/1. The above reaction products in combination with surfactant systems improves the gloss of substrates it cleans, increases detergency and, in addition, has surprisingly good caustic solubility. As discussed above, it is understood that EO stands for the residue of ethylene oxide and PO stands for the residue of propylene oxide and BO stands for the residue of butylene oxide.

A gloss synergy occurs with the aforementioned combination, in that the gloss retention of a cleaned surface is better when the combination of the surfactant and reaction product are used than when either the surfactant or the reaction product is used alone in like quantities. The aforementioned reaction products are added to a surfactant in an amount sufficient to enhance gloss retention and or increase detergency, and are referred to herein as gloss retention additives.

The reaction products have the advantage of being totally dispersible in water, are biodegradable, contain no organic solvents and improve the hard surface detergency of surfactants with which they are used.

The present invention is also directed to a hard surface cleaning composition containing:

(A) an alkyl polyglycoside corresponding to formula I:

$$R^1O(R^2O)_b(Z)_a \qquad \text{I}$$

wherein $R^1$ is a monovalent organic radical having from about 6 to about 30 carbon atoms; $R^2$ is a divalent alkylene radical having from 2 to 4 carbon atoms; Z is a saccharide residue having 5 or 6 carbon atoms; b is a number having a value from 0 to about 12; a is a number having a value from 1 to about 6; and (B) a gloss retention additive comprising at least one product of the reaction between:

a) at least one linking agent of formula IV:

$$R^4(Y)_3 \qquad \text{(IV)}$$

wherein each Y group is a halogen atom or one Y group is a halogen atom and two Y groups with two adjacent carbon atoms in the $R^4$ group and an oxygen atom form an epoxy group, and $R^4$ is an alkanetriyl group containing from 3 to 10 carbon atoms; and (b) at least one compound of formula (II)

$$R^3(EO)_n(PO)_mX \qquad \text{(II)}$$

wherein $R^3$ is a substituted or unsubstituted saturated or unsaturated, aliphatic oxy or thio group having from 1 to about 36 carbon atoms or a secondary amino group having from 2 to about 36 carbon atoms; n, m, and p are independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component a) to component b) is from about 0.2/1 to about 5/1.

DESCRIPTION OF THE INVENTION

Except in the operating examples, or where otherwise expressly indicated, all numerical quantities in this description indicating amounts of material or conditions of reaction and/or use are to be understood as modified by the word "about". Practice within the numerical limits stated is generally preferred. Also, throughout this description, unless expressly stated to the contrary: percent, "parts" of, and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ by chemical reactions specified in the description, and does not necessarily preclude other chemical interactions among the constituents of a mixture once mixed.

The products of the reaction of the linking compound of formula (IV) and compounds having the formula (II) will be referred to as the gloss retention additive.

The surprising discovery has been made that gloss retention properties and detergency of surfactant compositions can be improved by the addition of an effective amount of a gloss retention additive of the invention.

When used to improve gloss retention or detergency, the gloss retention additives are added to a surfactant system comprised of one or more surfactants, preferably in an aqueous system, in an amount effective to enhance the gloss retention of the cleaning composition when used to clean a substrate or improve detergency of a cleaning composition. In addition to the detergency and gloss enhancing properties, these compounds also have foam reducing properties, for example, see U.S. Pat. No. 5,827,453, the entire contents of which are herein incorporated by reference. The products of the reaction of the linking agent of formula (IV) and compounds having the formula (II) can therefore be used either as a gloss additive, to increase detergency of a surfactant, or as foam reducer or can be used for any combination of these purposes. The amount required to enhance the gloss of a substrate is defined as a gloss retention effective amount and will vary from one instance to another depending upon the nature of the surfactant or mixture of surfactants and the gloss retention effect desired. A gloss retention effective amount will be readily determinable by one of ordinary skill in the art.

The linking agent of formula (IV) is preferably epichlorohydrin although other epihalohydrins can be used. Also, trihaloalkanes can be used, such as 1,2,3-trichloropropane, 1,2,4-trichlorobutane, 1,3,6-trichlorohexane and the like. Instead of chlorine in the epihalohydrins and the trihaloalkanes, the corresponding bromine and iodine compounds can also be used, including compounds containing two or even three of the above halogens.

In regard to formula II, the nonoxy and nonthio components of the $R^3$ aliphatic group can be any substituted or unsubstituted, saturated or unsaturated aliphatic moiety having from 1 to 36 carbon atoms. Thus, the nonthio and the nonoxy components of the $R^3$ aliphatic group can be linear or branched alkyl groups, linear or branched alkenyl or alkynyl groups, saturated carbocyclic moieties, unsaturated carbocyclic moieties having one or more multiple bonds, saturated heterocyclic moieties, unsaturated heterocyclic moieties having one or more multiple bonds, substituted linear or branched alkyl groups, substituted linear or branched alkenyl or alkynyl groups, substituted saturated carbocyclic moieties, substituted unsaturated carbocyclic moieties having one or more multiple bonds, substituted saturated heterocyclic moieties, and substituted unsaturated heterocyclic moieties having one or more multiple bonds. Examples of the above include but are not limited to an alkyl group having from 4 to 22 carbon atoms, an alkenyl group having from 4 to 22 carbon atoms, and an alkynyl group having from 4 to 22 carbon atoms. $R^3$ can also be an arenyl group. Arenyl groups are alkyl-substituted aromatic radicals having a free valence at an alkyl carbon atom such as a benzylic group. Alkyl groups having from 4 to 12 carbon atoms are preferred, and alkyl groups having from 8 to 10 carbon atoms are most preferred. The degree of ethoxylation is preferably from 2 to about 50 with the most preferred being from about 4 to about 50 while the degree of propoxylation and butoxylation can vary from 0 to about 50, preferably from 1 to about 10. The degree of propoxylation and or butoxylation will be determined by the desired degree of water solubility or miscibility. The water solubility or miscibility will ultimately be determined by such factors as the number of carbon atoms in $R^3$, the relative amounts EO, PO and BO and the effect of PO and BO on the biodegradability of the final gloss additive. The water solubility or miscibility of a gloss additive according to the invention and the interrelationships between the number of carbon atoms in $R^3$, the relative amounts of EO, PO and BO and the biodegradability of the final product will be readily determinable by one of ordinary skill in the art.

When the X group of formula (II) is a mercapto group, the $R^3$ group will preferably have from about 4 to about 36 carbon atoms, n is from 0 to about 50, m is from 0 to about 50 and p is from 0 to about 50, examples of which include but are not limited to, alkoxylated dodecyl mercaptan and alkoxylated 1-hexadecanethiol.

The compounds of formula (II) can be alkoxylated or non-alkoxylated secondary amines. When the compounds of formula II are secondary amines, n is a number from 0 to 50, preferably from 1 to 50, m is a number from 0 to 50 and p is a number form 0 to 50, preferably from 1 to 50. Examples of the secondary amines useful for the purposes of the invention include but are not limited to, alkoxylated dibutyl amine, alkoxylated dicyclohexyl amine, alkoxylated diethylethanolamine, and alkoxylated dioctylamine.

Optionally an additional component can be reacted with the linking agent of formula (IV) and the compound of formula (II). A glycidyl ether or amine can be added to the reaction of formula (IV) and formula (II). The amount of the glycidyl ether or glycidyl amine is from about 1 to about 20 mole percent based on the moles of Formula (II) used in the reaction. When the glycidyl ether or glycidyl amine is added to the monofunctional starting material of formula II the ratio of formula IV to Formula II plus the glycidyl ether or glycidyl amine is preferably from about 0.8 to about 1.4. Examples of the glycidyl ethers include, but are not limited to, PEG 600 Diglycidyl ether, TETRONIC™ 701 Tetraglycidyl ether, Triglycidyl Di or Triethanolamine, Polyoxyethylene (POE) 200 Tallow amine diglycidyl ether, Propoxylated (POP10). Trimethylol propane triglycidyl ether, Propoxylated (POP7) Pentaerythritol tetraglycidyl ether. Examples of Glycidyl amines include but are not limited to, Tetraglycidyl 1,6-Hexane diamine, Tetraglycidyl JEFFAMINE™ EDR-148, and Tetraglycidyl Isophorone diamine.

The composition comprising the gloss retention additive and the surfactant can be made as a concentrate and then diluted with water to the desired cleaning strength.

When used as a gloss retention additive, the composition according to the invention is added to surfactants, preferably aqueous surfactant systems, and even more preferably to aqueous alkyl polyglycoside surfactant systems. The aqueous surfactant system will typically have a mixture of surfactant and gloss retention additive in an amount of from about 0.05 to about 5% active ingredients, preferably, from about 0.2 to about 1.5% active ingredients, and more preferably from about 0.2 to about 0.5% active ingredients by weight of the aqueous system. The amount required in any particular instance will be readily determinable by those of ordinary skill in the art. The gloss retention effective amount will typically vary from a weight ratio of surfactant to gloss retention additive of from about 20:1 to about 1:10, and preferably from about 10:1 to about 3:1 and more preferably from about 5:1 to about 4:1. The composition according to the invention is especially useful for enhancing gloss retention of compositions containing one or more alkyl polyglycoside surfactants.

It has also been found that aqueous compositions that are builder free and organic solvent free composed of alkyl polyglycoside surfactants and gloss retention additives, preferably containing from 0.2 to 0.5% of the above total active ingredients by weight of the aqueous composition, especially those having from about 10:1 to 8:1, and preferably about 9:1 weight ratio of surfactant gloss retention additive, are unusually effective as glass cleaners. Glass cleaned with such compositions have a marked anti-condensation effect, i.e., little or no condensation when the glass at a cold temperature is exposed to a warm, moist environment.

Detergency is a measure of the ability of a cleaning solution to remove dirt from a substrate. It has surprisingly been found that mixtures of the gloss retention additive and a surfactant, preferably an alkyl polyglycoside, in a weight ratio of surfactant to gloss retention additive of from about 20:1 to about 1:10, preferably from about 10:1 to about 3:1 and more preferably from about 4:1 to about 5:1 have improved detergency properties, as compared to the surfactants by themselves. Thus, a synergy in detergency is observed when using surfactant compositions in combination with the gloss retention additive in accordance with the present invention.

When the gloss retention additive is used to improve detergency of a surfactant system, the compounds according to the invention are added to a surfactant system, preferably an aqueous surfactant system. The preferred surfactant system comprises an alkyl polyglycoside surfactant. The aqueous surfactant system typically has a mixture of surfactant and gloss retention additive in an amount of from about 0.05 to about 5% active ingredients, by weight of the aqueous system and more preferably, from about 0.5 to about 1.5%. The amount required in any particular instance will be readily determinable by those of ordinary skill in the art.

The following advantages have been observed when the surfactant composition of the present invention is employed for cleaning, as opposed to the use of either the alkylpolyglycoside or the gloss retention additive by itself, those advantages being: (1) an improvement in overall soil removal; and (2) the synergy in detergency performance enables the formulator to decrease the amount of surfactant actives actually used in the final product, resulting in a formulation cost savings to the consumer.

In general, the surfactants which may be present in the surfactant compositions of the present invention are selected from the group consisting of anionic, amphoteric, zwitterionic, cationic, nonionic surfactants, and mixtures thereof.

Anionic surfactants are broadly described as surface active compounds having one or more negatively charged functional groups. Included in this category is a C8–C22 alkyl fatty acid salt of an alkali metal, alkaline earth metal, ammonium, alkyl substituted ammonium or alkanolammonium salt. Sodium salts of tallow and coconut fatty acids and mixtures thereof are most common. Another important class of anionic compounds are the water-soluble salts, particularly the alkali metal salts, of organic sulfur reaction products having in their molecular structure an alkyl radical containing from about 8 to 22 carbon atoms and a radical selected from the group consisting of sulfonic and sulfuric acid ester radicals. Organic sulfur based anionic surfactants include the salts of C10–C16 alkylbenzene sulfonates, C10–C22 alkane sulfonates, C10–C22 alkyl ether sulfates, C10–C22 alkyl sulfates, C4–C10 dialkylsulfosuccinates, C10–C22 acyl isothionates, alkyl diphenyloxide sulfonates, alkyl naphthalene sulfonates, and 2-acetamido hexadecane sulfonates. Organic phosphate based anionic surfactants include organic phosphate esters such as complex mono- or diester phosphates of hydroxyl-terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. A particularly preferred class of nonionics are the linear alcohol ethoxylates having from 2 to about 12 ethylene oxide moieties.

Amphoteric surfactants are surface-active agents containing both anionic and cationic groups or functional groups capable of carrying both ionic charges. One class of amphoteric surfactants are derivatives of aliphatic and tertiary amines, in which the aliphatic radical may be straight chain or branched and wherein one of the aliphatic substituents contains from about 8 to about 18 carbons and one contains an anionic water-solubilizing group, i.e., carboxy, sulpho, sulphato, phosphate or phosphono. Examples of such compounds are sodium 3-dodecylaminopropionate and sodium 2-dodecylaminopropane sulfonate. Zwitterionic surfactants are a subclass of amphoteric surfactants, some examples of which include, but are not limited to derivatives of aliphatic quaternary ammonium, phosphonium and suphonium compounds in which the aliphatic radical may be straight chained or branched, and wherein one of the aliphatic substituents contains from about 8 to about 18 carbon atoms and one contains an anionic water-solubilizing group, e.g., carboxy, sulpho, sulphato, phosphato or phosphono. These compounds are frequently referred to as betaines and include alkyl betaines, alkyl amino and alkyl amido betaines.

Nonionic surfactants are broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Examples of suitable nonionic surfactants include, but are not limited to, polyoxyethylene or polyoxypropylene condensates of aliphatic carboxylic acids, whether linear or branched-chain and unsaturated or saturated, containing from about 8 to about 18 carbon atoms in the aliphatic chain and incorporating from 2 to about 50 ethylene oxide and/or propylene oxide units. Suitable carboxylic acids include coconut fatty acids which contain an average of 12 carbon atoms, tallow fatty acids which contain an average of about 18 carbon atoms, palmitic acid, myristic acid, stearic acid and lauric acid.

Another example of useful nonionic surfactants include polyoxyethylene or polyoxypropylene condensates of aliphatic alcohols, whether linear- or branched-chain and unsaturated or saturated, containing from about 6 to about 24 carbon atoms and incorporating from 2 to about 50 ethylene oxide and/or propylene oxide units. Suitable alcohols include coconut fatty alcohol, tallow fatty alcohol, lauryl alcohol, myristyl alcohol and oleyl alcohol.

A particularly preferred class of nonionic surfactants are the alkyl polyglycosides of formula I:

$$R^1O(R^2O)_b(Z)_a \qquad \text{I}$$

wherein $R^1$ is a monovalent organic radical having from about 6 to about 30 carbon atoms; $R^2$ is a divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula I wherein Z is a glucose residue and b is zero. Such alkyl polyglycosides are commercially available, for example, as APG®, GLUCOPON®, or PLANTAREN® surfactants from Cognis Corporation, Ambler, Pa., 19002. Examples of such surfactants include but are not limited to:

1. GLUCOPON® 225 Surfactant—an alkyl polyglycoside in which the alkyl group contains 8 to 10 carbon atoms and having an average degree of polymerization of 1.7.
2. GLUCOPON® 425 Surfactant—an alkyl polyglycoside in which the alkyl group contains 8 to 16 carbon atoms and having an average degree of polymerization of 1.5.
3. GLUCOPON® 625 Surfactant—an alkyl polyglycoside in which the alkyl group contains 12 to 16 carbon atoms and having an average degree of polymerization of 1.6.
4. APG® 325 Surfactant—an alkyl polyglycoside in which the alkyl group contains 9 to 11 carbon atoms and having an average degree of polymerization of 1.5.
5. GLUCOPON® 600 Surfactant—an alkyl polyglycoside in which the alkyl group contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.5.
7. PLANTAREN® 1300 Surfactant—a $C_{12-16}$ alkyl polyglycoside in which the alkyl group contains 12 to 16 carbon atoms and having an average degree of polymerization of 1.6.
8. GLUCOPON® 220 Surfactant—an alkyl polyglycoside in which the alkyl group contains 8 to 10 carbon atoms and having an average degree of polymerization of 1.5.

Other examples include N-methyl glucosamines, amine oxides, and alkyl polyglycoside surfactant compositions which are comprised of mixtures of compounds of formula I wherein Z represents a moiety derived from a reducing saccharide containing 5 or 6 carbon atoms; a is a number having a value from 1 to about 6 preferably from 1.4 to 1.7; b is zero; and $R^1$ is an alkyl radical having from 8 to 20 carbon atoms, preferably from 8 to 16 carbon atoms. The compositions are characterized in that they have increased surfactant properties and an HLB (hydrophile-lipophile balance) in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycosides and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and poly-glycosides, in the resulting product changes and the concentration in the product of the polyglycosides relative to the monoglycoside increases as well as the concentration of individual polyglycosides to the total, i.e., DP2 and DP3 fractions in relation to the sum of all DP fractions. Such compositions are disclosed in U.S. Pat. No. 5,266,690, the entire contents of which are incorporated herein by reference.

Preferred alkyl polyglycosides for use in this aspect of the invention include those wherein $R^1$ is a monovalent organic radical having from about 8 to about 16 carbon atoms; Z is a glucose residue; b is zero, and a is a number having a value from about 1.3 to about 1.6. Examples of suitable alkyl polyglycosides include those with a monovalent organic radical having from 9 to 11 carbon atoms, i.e., those derived from the oxo process, and those with a monovalent organic radical having from 8 to 10 carbon atoms.

With nonionic alkyloxylate surfactants, foaming is directly proportional to solubility. Typically nonionic surfactant blends which are low foaming are not soluble in alkaline solutions. It is understood that alkaline solutions are those that have a pH of greater than 7.0. Examples of alkaline solutions include but are not limited to aqueous solutions made with NaOH, KOH and the like. It has also been surprisingly found that the mixture of nonionic surfactants, preferably alkyl polyglycosides, and the gloss retention additive at a ratio of about 3:1 to about 10:1 is not only low foaming and gloss enhancing but also soluble in an alkaline solution. The surfactant/gloss retention additive combination at the above mentioned ratio was found to be completely soluble in a solution of 10% or less caustic. The preferred caustic solution is from about 0.5% to about 15% by weight caustic, and even more preferably from about 5% to about 10% caustic. Also R has been surprisingly found that the mixture of nonionic surfactant and the gloss retention additive at a ratio of about 1:1 (surfactant to gloss retention additive) to about 20:1 is soluble up to about 10% by weight in a 25% NaOH solution. The solubility of the mixture decreases at higher concentrations of caustic.

According to one aspect of the invention, there is provided a method of enhancing the gloss retention of a substrate comprising cleaning the substrate with an aqueous surfactant composition containing the gloss retention additive of the present invention and at least one surfactant selected from the group consisting of an anionic, a nonionic, a cationic, an amphoteric, a zwitterionic and mixtures thereof. The ratio of surfactant to the gloss retention compound is typically from about 20:1 to about 1:10, preferably from 20:1 to 1:1, more preferably from about 10:1 to about 3:1, and most preferably from about 5:1 to about 4:1.

According to one aspect of the invention, there is provided a method of improving the detergency of a surfactant solution comprising mixing the gloss retention additive of the present invention and an aqueous surfactant composition containing at least one surfactant selected from the group consisting of an anionic, a nonionic, a cationic, an amphoteric, a zwitterionic and mixtures thereof. As stated above, the ratio of surfactant to the gloss retention compound is typically from about 20:1 to about 1:10, preferably from 20:1 to 1:1, more preferably from about 10:1 to about 3:1, and most preferably from about 5:1 to about 4:1.

In a particularly preferred embodiment of the present invention, the surfactant components comprising the surfactant composition are nonionic surfactants, preferably an alkyl polyglycoside of formula I in combination with the gloss retention additive.

According to another aspect of the present invention, there is provided a process for enhancing the gloss retention properties of a surfactant composition comprising combining with the surfactant composition, the gloss retention additive of the invention in a weight ratio of active ingredients of from about 1:10 to about 20:1, preferably from about 1:1 to about 20:1, more preferably from about 3:1 to about 10:1, and most preferably from about 4:1 to about 5:1 by weight surfactant to gloss retention additive. If the gloss retention additive is added to an aqueous solution of surfactant then the ratio of surfactant to gloss retention additive remains as herein described above. Typically the percent gloss retention additive in an about 1% active aqueous solution of surfactant with the amount of gloss retention additive varies typically from about 0.1% to about 0.35%, and preferably from about 0.2% to about 0.25% based on the weight of the cleaning composition. The addition of the gloss retention compound to cleaning composition can be performed in any known conventional manner such as, for example, stirring.

The present invention also provides a process for imparting improved gloss retention properties onto substrates such as hard surfaces which include, but are not limited to, ceramic tiles, glass, synthetic surfaces (plastics etc.), and stainless steel. The process involves contacting the hard surfaces with the above-disclosed cleaning composition.

According to another aspect of the present invention, there is provided a process for improving the detergency of a surfactant composition comprising combining with the surfactant composition, the gloss retention additive of the invention in a weight ratio of active ingredients of from about 1:10 to about 20:1, preferably from about 1:1 to about 20:1, more preferably from about 3:1 to about 10:1, and most preferably from about 4:1 to about 5:1 by weight surfactant to gloss retention additive. If the gloss retention additive is added to an aqueous solution of surfactant then the ratio of surfactant to gloss retention additive remains as herein described above.

According to yet another embodiment of the present invention, there is provided a ready-to-use hard surface cleaning composition containing: (a) from about 0.05 to about 0.50%, and preferably about 0.11% by weight, of an alkyl polyglycoside corresponding to formula I wherein $R^1$ is a monovalent organic radical having from about 8 to about16 carbon atoms; Z is a glucose residue; b is zero; and a is a number having a value from about 1.3 to about 1.6; and (b) from about 0.01 to about 0.50%, and preferably about 0.025% by weight, of the gloss retention additive, and wherein the ratio by weight of (a) to (b) is from about 20:1 to about 1:10, preferably from 20:1 to 1:1, more preferably from about 10:1 to about 3:1, and most preferably from about 5:1 to about 4:1.

A chelating agent, if employed, may be used in an amount of from about 0.0004 to about 0.20% by weight, and preferably about 0.02% by weight, based on the weight of the composition. Suitable chelating agents for use in the present invention include, but are not limited, tetrasodium EDTA, HEDTA, HEDP, NTA, Cyclodextrins, Crown Ethers, Citrates, Lactates, Gluconates, Phosphates, and mixtures thereof. A particularly preferred chelating agent is tetrasodium EDTA.

A non-volatile solubilizer, if used, will be present in the composition in an amount of from about 0.0004 to about 0.80% by weight, and preferably about 0.04% by weight, based on the weight of the composition. Suitable non-volatile solubilizers for use in the present invention include, but are not limited to, short chain fatty alcohol sulfates having from 6 to 12 carbon atoms, SXS, Glycols, PEG, and mixtures thereof. A particularly preferred solubilizer is a fatty alcohol sulfate having 10 carbon atoms.

A non-volatile alkaline compound, if used, will typically be present in the composition in an amount of from about 0.05 to about 1.00% by weight, and preferably about 0.20% by weight, based on the weight of the composition. Suitable non-volatile alkaline compounds for use in the present invention include, but are not limited to, triethanolamine, NaOH, KOH and mixtures thereof. A particularly preferred non-volatile alkaline is triethanolamine.

Other auxiliary components may also be added to the above-described cleaning composition, without departing from the spirit of the invention. These include, but are not limited to, a dye component, a perfume component, and the like.

One advantage of the above-described cleaning composition, other than it being solvent-, and builder-free, is that it does not require the presence of a preservative in order to prolong its shelf life.

In addition to the advantages discussed above, the gloss retention additive/surfactant compositions of the invention also have the following advantages:

1. They do not stress crack synthetic surfaces when such surfaces are exposed to the compositions of the invention for long periods of time.
2. When used as foam reducers, compositions containing alkyl polyglycosides as the surfactant provide excellent low foam profiles at low temperatures, unlike other low foam nonionic surfactants which are usually low foaming only at higher temperatures. The gloss retention additive/surfactant compositions of the invention can be used in a wide range of applications, including but not limited to cleaning-in-place, e.g., bottling plants (bottle wash cleaning), food processing, and the like; machine dishwashing powders and liquids used for consumer as well as industrial purposes; flooring and wall cleaners for consumer, industrial, and institutional needs; metal cleaning including aqueous bath, soak cleaning, and high pressure spray cleaning; low foam or foam controlled laundry detergent compositions for consumer, industrial, and institutional uses; ultrasonic aqueous cleaning purposes; and the like.

According to yet another embodiment of the present invention, there is provided a cleansing wipe, made from a woven and/or non-woven material which contains a cleaning effective amount of the hard surface cleaning composition of the present invention. Ready-to-use cleansing wipes which contain a cleaning solution within the wipe and can be readily removed from a container and used to immediately clean a surface are growing in popularity. Since these wipes already contain the necessary cleaning solution absorbed therein, this eliminates the need for having to use a separate container from which the cleaning solution is discharged onto a soiled surface, and a separate substrate with which to wipe the soiled surface. The types of woven and/or non-woven substrates (wipes) commonly used to carry a cleaning solution are well known in the industry.

The present invention will be better understood from the examples which follow, all of which are intended to be illustrative only and not meant to unduly limit the scope of the invention. Unless otherwise indicated, percentages are on a weight-by-weight basis.

EXAMPLE 1

About 500 grams of an octyl/decyl blend alcohol (approximately 45% octyl and 55% decyl) ethoxylated with an average of 4 moles of ethylene oxide (179 OH value) were mixed with 102 grams of 50% aqueous NaOH. The water was removed by azeotropic distillation until a moisture level of less than 0.8% was reached. The mixture was cooled to 60° C. and about 89 grams of epichlorohydrin were slowly added over 45 minutes. This mixture was allowed to react at 100–110° C. for 6 hours. An aliquot of this mixture was removed and filtered to remove the NaCl to give an easily pourable liquid product with Gardner color of 4–6, that was dispersible in water.

EXAMPLE 2

Method of Determination of Gloss Retention of Hard Surface Cleaners

1. Four black ceramic tiles were washed with detergent and water using a sponge. Tiles were manually dried.
2. The gloss of the clean tiles was measured using Gardner Micro-Tri-Gloss at a 20° angle of incidence. Ten measurements were made on each tile and averaged to yield the initial gloss for each tile.

15 drops of test solution were placed on each tile using a disposable pipette.

1. Using light pressure, the test solution was spread over each tile surface by 20 cycles with a folded kimwipe tissue.
2. Using light pressure each tile was again wiped for 20 cycles with a new folded kimwipe tissue, or allowed to air dry.
3. The tiles were allowed to dry completely (usually<10 min.).
4. The final gloss of each test solution was measured as in step 2.
5. The gloss retention was calculated as $$\% \text{ gloss retention} = (\text{average final gloss}/\text{average initial gloss}) * 100$$

The mixture of the gloss retention additive from example 1 and GLUCOPON® 220N were combined in a ratio of 2.4:1 active ingredients of GLUCOPON® 220N to gloss retention additive. This mixture was then diluted with water to produce a solution of 1% active ingredients. Gloss tests were carried out on the 1% active solution, the gloss retention additive alone (1% active in water), and the GLUCOPON® 220N alone (1% active in water).

| | % Gloss Retention |
|---|---|
| GLUCOPON ® 220N | 99.3 |
| gloss retention additive | 93.9 |
| GLUCOPON ® 220N:gloss retention additive | 100.2 |

EXAMPLE 3

The mixture of gloss retention additive from example 1 and GLUCOPON® 425N were combined in a ratio of 9.5:1 active ingredients of GLUCOPON® 425N to gloss retention additive. This mixture was then diluted with water to produce a solution of 1% active-ingredients. Gloss tests were carried out on the 1% active solution, the gloss retention additive alone (1% active in water), and the GLUCOPON® 425N alone (1% active in water).

The Method of sample 2 was used to calculate the % gloss retention.

| | % Gloss Retention |
|---|---|
| GLUCOPON ® 425N | 97.5 |
| gloss retention additive | 93.9 |
| GLUCOPON ® 425N:gloss retention additive | 100.5 |

EXAMPLE 4

The mixture of gloss retention additive from example 1 and GLUCOPON® 425N were combined in a ratio of 4.5:1 active ingredients of GLUCOPON® 425N to gloss retention additive. This mixture was then diluted with water to produce a solution of 1% active ingredients. Detergency tests were carried out on the 1% active solution and the GLUCOPON® 425N alone (1% active in water) using the following method.

Hard Surface Detergency Method:

A test soil, H6, was made up of 50 parts kerosene, 5 parts vegetable oil, 7 parts mineral oil, 25 parts brandy black clay and 1 part carbon black.

Test Method:

Measure reflectance of unsoiled tiles.

Apply 0.5 ml of soil to the rough side of 3"×3" vinyl tile or panel. Spread the soil with the "grain" on the panel, using a nylon brush. Dry panels for 20 minutes at room temperature, then for 20 minutes at 100° C., and then for a final 20 minutes at room temperature.

Cleaning Operation:

Measure reflectance of soiled tiles.

Place two soiled test panels in Gardner Apparatus wash tray, (described in ASTM D4488 method, subpart A2.2.3 as a straight line washability apparatus) with the "grain" parallel to the direction of sponge travel.

Add 200 ml of test solution to the wash tray. Let stand one minute.

Scrub test panels with a synthetic sponge for 40 cycles, rotating panels 90 degrees after 20 cycles.

Rinse panels with DI water and dry at room temperature for at least one hour.

Repeat steps 1–4 for a total of four panels for each test solution.

Measure reflectance of washed tiles after drying period.

$$\% \text{ Soil Removal} = (Rw - Rs)/(Ru - Rs) \times 100$$

Rw=Reflectance of washed panel

Rs=Reflectance of soiled panel

Ru=Reflectance of unsoiled panel

Detergency test results for GLUCOPON® 425N:gloss retention additive, in a ratio of 4.5:1 using a 1% active solution on tiles soiled with H6 soil, 23° C.

| | % Soil Removal |
|---|---|
| GLUCOPON ® 425N | 50.5 |
| GLUCOPON ® 425N:gloss retention additive | 62.5 |

EXAMPLE 5

Reaction

To a 1 liter reactor set up with stirring attachment, deans-stark trap and friedrichs condenser, temperature control thermocouple and heating mantle, and Nitrogen inlet, 700 gms (1.81 OH equivs) of predried alkoxylated octanol (octyl alcohol containing 2 moles of ethylene oxide and 2 moles of butylene oxide) and 203 gms of epichlorohydrin (2.17 moles) are added. Stirring under slow N2 sweep, warm to about 60° C. and add 0.25 gms of BF3 etherate. Exotherm will rise and subside. When temperature returns to 60–80° C., add 0.25 more gms of BF3 etherate. Again exotherm will rise and subside. Repeat BF3 etherate additions until the perchloric acid in glacial acetic acid 'oxirane titration' indicates no unreacted epoxide indicating complete conversion to chlorohydrins.

At this point it is heated to 100° C. and, through an addition funnel over 1 hour, 208 gms (2.6 equivalents) of 50% aqueous sodium hydroxide is added. Heat and stirring are maintained until the perchloric acid in glacial acetic acid 'oxirane titration' indicates no unreacted epoxide. Acetic acid is added to neutralize residual alkali and vacuum is applied to distill moisture of and precipitate salts. The salt is then removed via pressure filter to give dark amber liquid.

EXAMPLE 6

To a 1 liter reactor set up with stirring attachment, deans-stark trap and friedrichs condenser, temperature control thermocouple and heating mantle, and Nitrogen inlet, add 700 gms (1.14 OH equivalents) of predried alkoxylated dicyclohexyl amine (dicyclohexylamine with 6 moles of ethylene oxide and 3 moles of propylene oxide). Start stirring with nitrogen sweep and add 27.4 gms (1.14 moles) of sodium hydride in 5 gram increments, waiting for exotherm and gas evolution to subside before adding the next increment. When additions are complete warm to 80° C. and add, through an addition funnel over 1 hour, 85.2 gms (0.91 moles) of epichlorohydrin. When addition is complete hold for another hour then heat to 120° C. and hold until the perchloric acid in glacial acetic acid 'oxirane titration' indicates no unreacted epoxide. Add hydroxyacetic acid to neutralize residual alkali, pull vacuum to distill off moisture and precipitate salts. Filter out salt through pressure filter to give dark amber liquid.

EXAMPLE 7

To a 1 liter reactor set up with stirring attachment, deans-stark trap and friedrichs condenser, temperature control thermocouple and heating mantle, and Nitrogen inlet, 600 gms (3 SH equivalents) of predried dodecyl mercaptan is added. To this 180 gms (3.3 moles) of solid sodium methoxide is added. Vacuum is applied and the material is slowly heated to 100° C. to distill off methanol. When distillation stops, vacuum is released with nitrogen and the material is cooled to 60° C. A mixture of 92 gms (0.8 epoxy equivalents) of hexylene glycol diglycidyl ether and 259 gms (2.8 moles) of epichlorohydrin are added slowly controlling the exotherm below 100° C. When addition is complete hold for another hour then heat to 140° C. and hold until the perchloric acid in glacial acetic acid 'oxirane titration' indicates no unreacted epoxide. Cool to below 100° C. Add phosphoric acid to neutralize residual alkali to pH=7, pull vacuum to distill off moisture and precipitate salts. Filter out salt through pressure filter to give dark amber liquid.

EXAMPLE 8

A hard surface cleaning composition in accordance with the present invention was formulated, the ingredients of which are found in Table 1, below.

TABLE 1

| Ingredient | %/wt |
|---|---|
| Tetrasodium EDTA (38%) | 0.05 |
| GLUCOPON ® 425N (50%) | 0.225 |
| DEHYPON ® ST-15 | 0.025 |
| SULFOTEX ® 110 (40%) | 0.10 |
| ACID BLUE 185 (DYE) | TRACE |
| AMMONIUM HYDROXIDE (29%) | 0.20 |
| WATER | 99.40 |

GLUCOPON® 425N=is a C8–C16 alkyl polyglycoside having a degree of polymerization of from about 1.4 to about 1.5.

DEHYPON® ST-15=is the reaction product of an ethoxylated C8–C10 linear fatty alcohol having 4.5 moles of EO, reacted with epichlorohydrin.

SULFOTEX® 110=is a C10 fatty alcohol sulfate.

The above-disclosed cleaning composition was evaluated in a panel test, the results of which are found in Table 2, below.

TABLE 2

| PROPERTY EVALUATED | RATING |
|---|---|
| Cleaning ability | Very good to excellent |
| Ease of wiping | Very good to excellent |
| Non-streaking/filming | Very good to excellent |
| Gloss of treated glass | Very good to excellent |
| Rate of drying | Good to very good |
| Foam formation | Good to very good |
| Overall performance | Very good to excellent |

EXAMPLE 9

A formulation has been developed for an RTU All-Purpose Spray Cleaner which contains no V.O.C.'s and yet exhibits superior hard surface cleaning performance to two national brands All Purpose Spray Cleaners ("Fantastik" and "409") both of which contain a volatile glycol ether solvent:

C436-1, Non V.O.C. All-purpose Cleaner, RTU

| | % wt. |
|---|---|
| Water | 95.40 |
| Tetrasodium EDTA (38%) | 0.70 |
| Sodium Hydroxide (50%) | 0.20 |
| Triethanolamine | 1.20 |
| GLUCOPON ® 425N | 2.25 |
| DEHYPON ® ST-15 | 0.25 |

Physical Properties of RTU All-Purpose Spray Cleaners:

| | C-4-36-1 | "Fantastik" | "409" |
|---|---|---|---|
| pH | 12.40 | 12.10 | 12.40 |
| % NV | 3.10 | 1.62 | 1.52 |
| SpGr | 1.005 | 0.997 | 0.998 |
| Cloud Point | 108° F. | >120° F. | >120° F. |

What is claimed is:

1. A composition comprising:

(A) an alkyl polyglycoside corresponding to formula I:

$$R^1O(R^2O)_b(Z)_a \qquad \text{I}$$

wherein $R^1$ is a monovalent organic radical having from about 6 to about 30 carbon atoms; $R^2$ is a divalent alkylene radical having from 2 to 4 carbon atoms; Z is a saccharide residue having 5 or 6 carbon atoms; b is a number having a value from 0 to about 12; a is a number having a value from 1 to about 6;

(B) at least one product of a reaction between:

a) at least one linking agent of formula IV:

$$R^4(Y)_3 \qquad \text{(IV)}$$

wherein each Y group is a halogen atom or one Y group is a halogen atom and two Y groups with two adjacent carbon atoms in the $R^4$ group and an oxygen atom form an epoxy group, and $R^4$ is an alkanetriyl group containing from 3 to 10 carbon atoms, and (b) at least one compound of formula (II)

$$R^3(EO)_n(PO)_m(BO)_pX \qquad \text{(II)}$$

wherein $R^3$ is a substituted or unsubstituted saturated or unsaturated, aliphatic oxy or thio group having from 1 to about 36 carbon atoms or a secondary amino group having from 2 to about 36 carbon atoms; n, m, and p are Independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component a) to component b) is from about 0.2/1 to about 5/1; and (C) a solubilizer.

2. The composition of claim 1 wherein in component B) the mole ratio of (a) to (b) is from about 0.4/1 to about 2/1.

3. The composition of claim 1 wherein in component B) the mole ratio of (a) to (b) is from about 0.4/1 to about 1.6/1.

4. The composition of claim 1 wherein in formula II p is a number of from 1 to about 50.

5. The composition of claim 1 wherein the ratio by weight of component A) to component B) is from about 20:1 to about 1:10.

6. The composition of claim 1 wherein in formula I, $R^1$ is a monovalent organic radical having from 8 to 16 carbon atoms, b is zero, and a is a number from about 1.3 to about 1.6.

7. The composition of claim 1 wherein in formula II $R^3$ is an alkyl group having from about 4 to about 12 carbon atoms.

8. The composition of claim 7 wherein the alkyl group contains from about 8 to about 10 carbon atoms.

9. The composition of claim 1 wherein in formula II n is a number from about 2 to about 50.

10. The composition of claim 6 wherein the alkyl polyglycoside is present in the composition in an amount of from about 0.05 to about 50.0% by weight, based on the weight of the composition.

11. The composition of claim 1 wherein in formula II $R^3$ is an alkyl group having from 4 to 12 carbon atoms and n is a number from about 2 to about 50.

12. The composition of claim 1 wherein in formula II $R^3$ is an alkyl group having from 8 to 10 carbon atoms and n is a number from about 4 to about 50.

13. The composition of claim 1 wherein in formula II, X is hydrogen and p is a number of from 1 to about 50.

14. The composition of claim 1 wherein in formula II X is a mercapto group or an amino group.

15. The composition of claim 1 wherein in formula II $R^3$ is an aliphatic thio group.

16. The composition of claim 1 wherein (B) is present in the composition in an amount of from about 0.01 to about 10.0% by weight, based on the weight of the composition.

17. The composition of claim 1 further comprising a chelating agent.

18. The composition of claim 17 wherein the chelating agent is present in the composition in an amount of from about 0.0004 to about 10.0% by weight, based on the weight of the composition.

19. The composition of claim 1 wherein the solubilizer is present in the composition in an amount of from about 0.0004 to about 8.0% by weight, based on the weight of the composition.

20. The composition of claim 1 further comprising a non-volatile alkaline component.

21. The composition of claim 20 wherein the non-volatile alkaline component is present in the composition in an amount of from about 0.05 to about 15% by weight, based on the weight of the composition.

22. A composition comprising:

(A) from about 0.05 to about 0.50% by weight of an alkyl polyglycoside corresponding to formula I:

$$R^1O(R^2O)_b(Z)_a \quad \text{I}$$

wherein $R^1$ is a monovalent organic radical having from about 8 to about 16 carbon atoms; $R^2$ is a divalent alkylene radical having from 2 to 4 carbon atoms; Z is a saccharide residue having 5 or 6 carbon atoms; b is zero; a is a number having a value from about 1.3 to about 1.6;

(B) from about 0.01 to about 0.50% by weight of at least one product of a reaction between:

a) at least one linking agent of formula IV:

$$R^4(Y)_3 \quad \text{(IV)}$$

wherein each Y group is a halogen atom or one Y group is a halogen atom and two Y groups with two adjacent carbon atoms in the $R^4$ group and an oxygen atom form an epoxy group, and $R^4$ is an alkanetriyl group containing from 3 to 10 carbon atoms; and (b) at least one compound of formula (II)

$$R^3(EO)_n(PO)_m(BO)_pX \quad \text{(II)}$$

wherein $R^3$ is a substituted or unsubstituted saturated or unsaturated, aliphatic oxy or thio group having from 1 to about 36 carbon atoms or a secondary amino group having from 2 to about 36 carbon atoms; n, m, and p are independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component a) to component b) is from about 0.2/1 to about 5/1;

(C) from about 0.0004 to about 0.20% by weight of a chelating agent;

(D) from about 0.0004 to about 0.80% by weight of a solubilizer;

(E) from about 0.05 to about 15% by weight of an alkaline component; and (F) remainder, water, all weights being based on the total weight of the composition, and wherein the composition is free of both builders and solvents based on volatile organic compounds.

23. A process for cleaning a hard surface comprising contacting the surface with a cleaning composition containing:

(A) an alkyl polyglycoside corresponding to formula I:

$$R^1(O)(R^2O)_b(Z)_a \quad \text{I}$$

wherein $R^1$ is a monovalent organic radical having from about 6 to about 30 carbon atoms; $R^2$ is a divalent alkylene radical having from 2 to 4 carbon atoms; Z is a saccharide residue having 5 or 6 carbon atoms; b is a number having a value from 0 to about 12; a is a number having a value from 1 to about 6;

(B) at least one product of a reaction between:

a) at least one linking agent of formula IV:

$$R^4(Y)_3 \quad \text{(IV)}$$

wherein each Y group is a halogen atom or one Y group is a halogen atom and two Y groups with two adjacent carbon atoms in the $R^4$ group and an oxygen atom form an epoxy group, and $R^4$ is an alkanetriyl group containing from 3 to 10 carbon atoms; and (b) at least one compound of formula (II)

$$R^3(EO)_n(PO)_m(BO)_pX \quad \text{(II)}$$

wherein $R^3$ is a substituted or unsubstituted saturated or unsaturated, aliphatic oxy or thio group having from 1 to about 36 carbon atoms or a secondary amino group having from 2 to about 36 carbon atoms; n, m, and p are independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component a) to component b) is from about 0.2/1 to about 5/1; and (C) a solubilizes.

24. The process of claim 23 wherein in component B) the mole ratio of (a) to (b) is from about 0.4/1 to about 2/1.

25. The process of claim 23 wherein in component B) the mole ratio of (a) to (b) is from about 0.4/1 to about 1.6/1.

26. The process of claim 23 wherein in formula II p is a number of from 1 to about 50.

27. The process of claim 23 wherein the ratio by weight of component A) to component B) is from about 20:1 to about 1:10.

28. The process of claim 23 wherein in formula I, $R^1$ is a monovalent organic radical having from 8 to 16 carbon atoms, b is zero, and a is a number from about 1.3 to about 1.6.

29. The process of claim 23 wherein in formula II $R^3$ is an alkyl group having from about 4 to about 12 carbon atoms.

30. The process of claim 29 wherein the alkyl group contains from about 8 to about 10 carbon atoms.

31. The process of claim 23 wherein in formula II n is a number from about 2 to about 50.

32. The process of claim 23 wherein the alkyl polyglycoside is present in the composition in an amount of from about 50% to about 0.50% by weight, based on the weight of the composition.

33. The process of claim 23 wherein in formula II $R^3$ is an alkyl group having from 4 to 12 carbon atoms and n is a number from about 2 to about 50.

34. The process of claim 23 wherein in formula II $R^3$ is an alkyl group having from 8 to 10 carbon atoms and n is a number from about 4 to about 50.

35. The process of claim 23 wherein in formula II, X is hydrogen and p is a number of from 1 to about 50.

36. The process of claim 23 wherein in formula II X is a mercapto group or an amino group.

37. The process of claim 23 wherein in formula II $R^3$ is an aliphatic thio group.

38. The process of claim 23 wherein (B) is present in the composition in an amount of from about 0.01 to about 10% by weight, based on the weight of the composition.

39. The process of claim 23 further comprising a chelating agent.

40. The process of claim 39 wherein the chelating agent is present in the composition in an amount of from about 0.0004 to about 10% by weight, based on the weight of the composition.

41. The process of claim 23 wherein the solubilizer is present in the composition in an amount of from about 0.0004 to about 8% by weight, based on the weight of the composition.

42. The process of claim 23 further comprising a non-volatile alkaline component.

43. The process of claim 42 wherein the non-volatile alkaline component is present in the composition in an amount of from about 0.05 to about 15% by weight, based on the weight of the composition.

44. A ready-to-use cleansing wipe made from a woven and/or non-woven substrate containing a cleaning-effective amount of the composition of claim 1.

* * * * *